US006499536B1

(12) United States Patent
Ellingsen

(10) Patent No.: US 6,499,536 B1
(45) Date of Patent: Dec. 31, 2002

(54) METHOD TO INCREASE THE OIL PRODUCTION FROM AN OIL RESERVOIR

(75) Inventor: Olav Ellingsen, Florø (NO)

(73) Assignee: Eureka Oil ASA, Floro (NO)

( * ) Notice: Subject to any disclaimer, the term of this patent is extended or adjusted under 35 U.S.C. 154(b) by 0 days.

(21) Appl. No.: 09/581,432

(22) PCT Filed: Dec. 17, 1998

(86) PCT No.: PCT/NO98/00383

§ 371 (c)(1),
(2), (4) Date: Jun. 13, 2000

(87) PCT Pub. No.: WO99/32757

PCT Pub. Date: Jul. 1, 1999

(30) Foreign Application Priority Data

Dec. 22, 1997 (NO) ..... 19976027

(51) Int. Cl.[7] ..... E21B 43/16
(52) U.S. Cl. ..... 166/248; 166/249; 166/371
(58) Field of Search ..... 166/248, 249, 166/369, 371, 372

(56) References Cited

U.S. PATENT DOCUMENTS

| | | | | |
|---|---|---|---|---|
| 2,680,485 A | | 6/1954 | Bodine | |
| 2,894,724 A | | 7/1959 | Andrew | |
| 3,048,226 A | | 8/1962 | Smith | |
| 3,282,826 A | | 11/1966 | Winkler | |
| 3,520,362 A | | 7/1970 | Galle | |
| 3,547,192 A | * | 12/1970 | Claridge et al. | 166/248 |
| 3,743,017 A | | 7/1973 | Fast et al. | |
| 3,842,907 A | | 10/1974 | Baker et al. | |
| 3,850,135 A | | 11/1974 | Galle | |
| 3,963,598 A | | 6/1976 | Manowitz et al. | |
| 4,250,015 A | | 2/1981 | Yang et al. | |
| 4,261,736 A | | 4/1981 | Dewing et al. | |
| 4,287,157 A | | 9/1981 | Koch | |
| 4,316,873 A | | 2/1982 | Koch | |
| 4,344,835 A | | 8/1982 | Koch | |
| 4,344,836 A | | 8/1982 | Koch | |
| 4,359,091 A | | 11/1982 | Fisher et al. | |
| 4,401,162 A | * | 8/1983 | Osborne | 166/248 |
| 4,471,838 A | | 9/1984 | Bodine | |
| 4,567,945 A | * | 2/1986 | Segalman | 166/248 |
| 4,579,173 A | | 4/1986 | Rosenweig et al. | |
| 4,705,108 A | * | 11/1987 | Little et al. | 166/248 |
| 4,884,594 A | | 12/1989 | Powers et al. | |
| 5,009,272 A | | 4/1991 | Walter | |
| 5,190,114 A | | 3/1993 | Walter | |
| 5,282,508 A | | 2/1994 | Ellingsen et al. | |
| 5,285,847 A | | 2/1994 | Halper et al. | |
| 5,323,855 A | | 6/1994 | Evans | |
| 5,465,789 A | | 11/1995 | Evans | |
| 5,586,602 A | | 12/1996 | Vagin | |
| 5,620,049 A | * | 4/1997 | Gipson et al. | 166/248 |
| 5,914,027 A | | 6/1999 | Ellingsen | |
| 6,086,655 A | | 7/2000 | Ellingsen et al. | |

FOREIGN PATENT DOCUMENTS

| | | |
|---|---|---|
| DE | 27 37 515 B2 | 7/1979 |
| DE | 3300365 | 12/1984 |
| FR | 2 539 903 | 2/1978 |
| JP | 54010274 | 1/1979 |
| NO | 161697 | 6/1989 |
| NO | 175847 | 12/1994 |
| WO | WO 91/15607 | 10/1991 |
| WO | WO 94/08680 | 4/1994 |

OTHER PUBLICATIONS

International Search Report for PCT/NO96/00250 dated Feb. 3, 1997. (See patent No. 6,086,655).
International Search Report dated Mar. 23, 1999 prepared by the Swedish Patent Office.

* cited by examiner

*Primary Examiner*—David Bagnell
*Assistant Examiner*—Jennifer Dougherty
(74) *Attorney, Agent, or Firm*—Merchant & Gould P.C.

(57) ABSTRACT

A method to increase the production of oil from an oil reservoir is described. The method includes injecting a magnetic or magnetostrictive material through an oil well into the oil reservoir, vibrating the material with the aid of an alternating electric field and removing oil from the oil well.

3 Claims, 6 Drawing Sheets

OIL WELLS ELECTROMAGNETIC VIBRATION STIMULATION
EUREKA OIL RECOVERY PRINCIPLE
ELECTRO ACOUSTIC RESERVOIR STIMULATION

The response of water permeability in core sample to application of an acoustic field with varying intensities. Frequency 26,5 kHz.(Cherskive et al., 1977)

METHOD TO INCREASE THE OIL PRODUCTION FROM AN OIL RESERVOIR

BACKGROUND OF THE INVENTION

The present invention is related to a method to increase the oil production from an oil reservoir.

Recovery of oil from oil reservoirs under electrical stimulation has been described for instance in NO 161.697 and U.S. Pat. No. 4,884,594 as well as U.S. Pat. No. 5,282,508 corresponding to NO. appl. 922581.

The above patents is related to an enhanced oil recovery method currently known as the Eureka Enhanced Oil Recovery (EEOR) principle which is an enhanced oil recovery method specially designed for land-based oil fields. The principle is based on electrical and sonic stimulation of the oil-bearing strata in such a manner that the oil flow is increased.

This is done by introducing special vibrations into the strata. These vibrations will be as identical to the natural frequency of the rock matrix and/or the fluids as possible.

The vibrations give rise to several effects in the fluids and remaining gases in the strata. They decrease the cohesive and adhesive bonding, as well as a substantial part of the capillary forces, thereby allowing the hydrocarbons to flow more easily in the formation.

The vibrations that propagate into the reservoir as elastic waves will change the contact angle between the rock formation and the fluids, thereby reducing the hydraulic coefficient of friction. This allows a freer flow towards the wells where the velocity increases and creates a greater pressure drop around the well. The elastic waves give rise to an oscillating force in the strata, which results in different accelerations because of the different densities in the fluids. The fluids will "rub" against each other because of the different accelerations to create frictional heat, which in turn reduces the surface tension on the fluids.

The vibrations also release trapped gas that contributes to a substantial gas lift of the oil. Furthermore, the oscillating force creates an oscillating sound pressure that contributes to the oil flow.

Heat is supplied to the reservoir to maintain and, at the same time, increase the pressure in the oil field when its natural pressure has been reduced. The heat is supplied both as frictional heat, from the vibrations, and also as alternating current into the wells. The electrical transmission capabilities always present in an oil field allow the alternating current to flow between wells to make the reservoir function in a manner similar to an electrode furnace because of resistance heating.

The heating causes a partial evaporation of the water and the lightest fractions of the hydrocarbons and remaining gases in the oil. Furthermore, the alternating current causes the ions in the fluids to oscillate and thereby creates capillary waves on the fluid interfaces and thus reduces the surface tensions, a phenomenon we have named "The in situ Electrified Surfactant Effect (IESE).

The heat created from the electrical stimulation and from the vibrations reduces the viscosity of the fluids.

The oil flow acts as a cooling medium that allows a greater energy density from the vibrator and the electricity supplied to the oil-producing wells.

A number of possibilities exist for the use of electricity to heat oil-bearing formations. These methods can be classified according to the dominant mechanism of thermal dissipation in the process. The line frequency plays a decisive role in how the electrical (and electromagnetic) energy is converted to heat. Dielectric heating prevails in the high-frequency range from radio frequencies to microwave frequencies. The dipoles formed by the molecules tend to align themselves with the electrical field. The alternation of this field induces a rotation movement of the dipoles with a velocity proportional to the alternation frequency. The molecular movement can be intense enough to produce considerable heat. A popular application of this process is in microwave ovens. Another possibility is inducing heating where the alternating electric current flows through a set of conductors, inducing a magnetic field in the medium. The variations of the magnetic fields, in turn, induce a secondary current whose circulation in the medium creates heat. This work is confined to the resistive heating process, which is the major mechanism when DC or low-frequency (up to 300 Hz) alternating current is used.

The electrical heating of a reservoir formation was used to enhance oil production as early as 1969, when an experiment in Little Tom, Tex., was successful. The production of four wells had increased from 1 bbl/d (0.16 $m^3$/d) to an impressive average of 20 bbl/d (3.18 $m^3$/d) for the experiment, which included wellbore fracturing. The method subsequently attracted the attention of an increasing number of investigators and engineers, and their field tests were reported within a few years. The first academic work on resistive heating was by El-Feky in 1977. He reported on the development and testing of a numerical model that was based on implicit-pressure, explicit-saturation formulation over a two-dimensional rectangular grid. Experimental data came from a laboratory model consisting of a five-spot water flood. The electrical concept was later coupled to water-injection processes to derive the so-called reservoir-selective-heating method.

Until 1986, the few existing reservoir simulators for the electrical enhanced process relied on explicit treatments to determine saturation, voltage, temperature, and pressure. Killough and Gonzales presented a fully explicit three-dimensional multicomponent model in 1986 that was capable of handling water vaporization. The authors focused on the idea of flood patterns for the heating water. In 1988, Watttenbarger and McDougal used a two-dimensional simulator to investigate the major parameters affecting the production response to electrical heating. They considered the steady-state regime to obtain a simple method for estimating the production rate.

Thomas Gordon Bell describes electroosmosis by electrolinking two or more oil wells In U.S. Pat. No. 2,799,641. William C. Pritchet describes a method and the apparatus for heating a subterranean formation by electrical conduction in U.S. Pat. No. 3,948,319. The method describes the use of alternating or direct current to preheat the formation.

Lloyd R. Kern describes the use of electricity to "melt" hydrates (a typical methane hydrate have the chemical formulation $CH_4H_2O$) formed in typical arctic shallow formations.

E. R. Abernathy discusses the use of electromagnetic heating of the area near an oil well. [REF Journal of Canadian Petroleum Technology, July–September 1976, Montreal]

A. Herbert Harvey, M.D. Arnold and Samy A. El-Feky report a study of the usability of an electric current in the selective heating of a portion of an oil reservoir that is normally bypassed by injected fluid. [REF Journal of Canadian Petroleum Technology, July–September 1979, Montreal]

A. Herbert Harvey and M.D. Arnold describe a radial model for estimating heat distribution in selective electric reservoir heating. [REF Journal of Canadian Petroleum Technology, October–December, 1980, Montreal]

Erich Sarapuu describes a method in underground electrolinking by an impulse voltage to make cracks in the formation in U.S. Pat. No. 3,169,577.

The contribution of the different liquids to the pressure buildup depends on the original pressure, temperature and liquid/gas relationship in the reservoir. In a reservoir with low gas content, pressure and temperature, the main contribution to the increased pressure comes from evaporation of water and lighter crude fractions, and from thermal expansion of the gas.

The temperature and pressure increase occur not only in the vicinity of the well, but also between the wells, depending on the paths of the electrical potential between the well.

The energy input for each well depends on the oil flow and the set temperature in the bottom zone. This means that for a particular electrode (casing) temperature, which depends on the equipment, the power input depends on the cooling effect of the oil produced. The greater the oil production, the greater the energy input possible because the increased heat at the well area is drained away by the oil produced. If no oil is produced, the heat flow into the formation from the well would take place by heat conduction only.

SUMMARY OF THE INVENTION

The invention is drawn to a method for increasing the oil production from an oil reservoir. A magnetic or magnetostrictive material is injected into the end oil reservoir and then the material is vibrated with the aid of an alternative electric field. Oil is then drawn from the same oil reservoir from the same well in which the magnetic or magnetostrictive material was injected. The vibrations created in the injected material can be changed by changing the frequency of the applied electric current passed into the reservoir.

BRIEF DESCRIPTION OF THE FIGURES

The invention may be more completely understood by considering the detailed description of various embodiments of the invention which follows with the accompanying drawings.

DETAILED DESCRIPTION OF THE FIGURES

Figure 1:
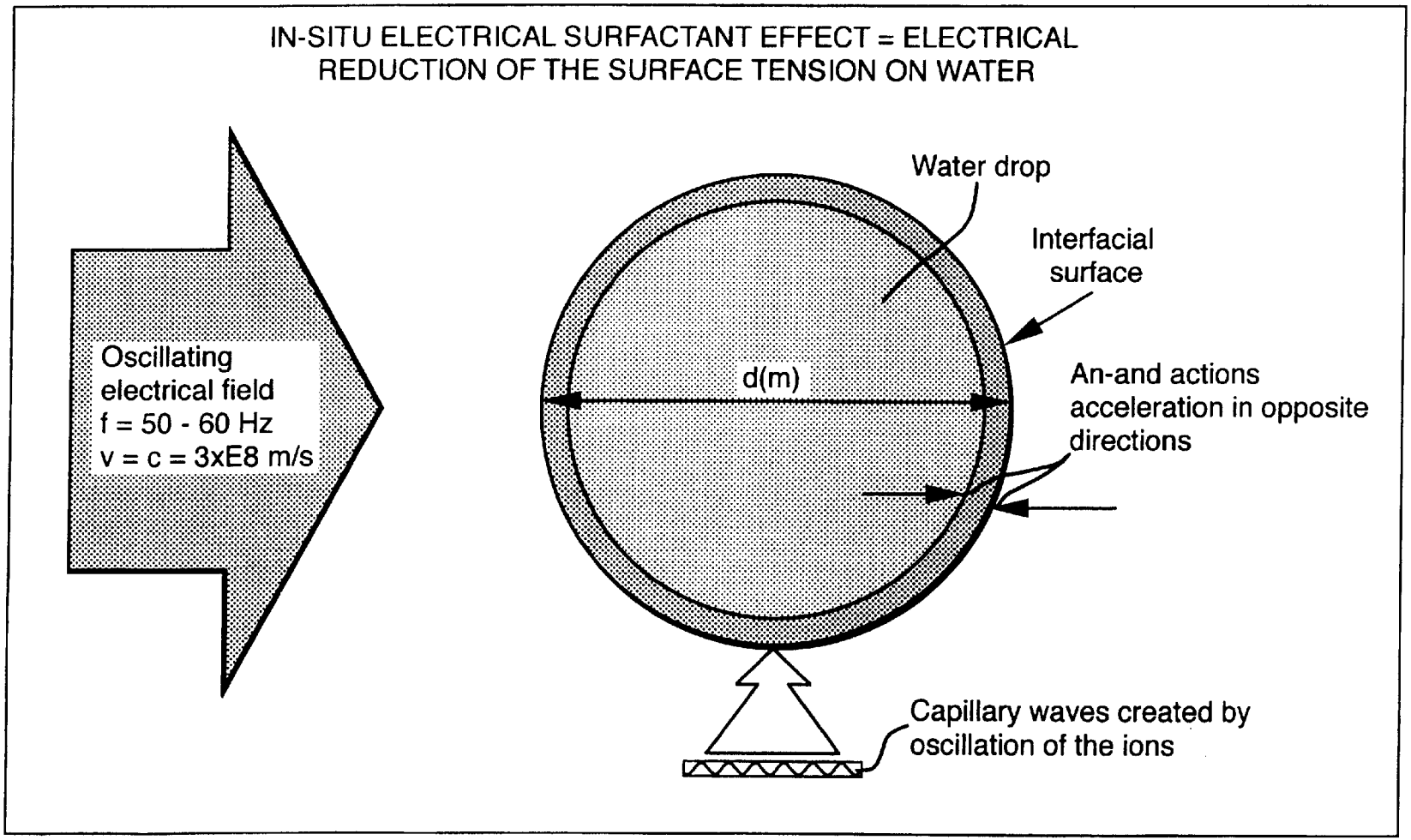
FIG. 1 (PRIOR ART)
FIG. 1 is a schematic drawing of a flow chart reflecting the basic components of an in-situ electrical surfactant effect that is known in the art.

In the EEOR process, we apply a low-frequency alternating current of 100 to 500 V, depending on the resistance in the reservoir. This electrical energy is delivered as a resistive heating process. The energy from the wellbore will be delivered logarithmically according to the formula E=U1*1nr/1nR.

During the development of the Eureka-process, we observed an immediate increased oil recovery using electricity and vibrations before one could expect a thermal effect. We concluded that this increase may be caused by the ions in the fluids oscillating in response to the electrical modulation.

Ions at the fluid boundaries can be polymerized to a thickness of several molecules. This means that the ions are more or less linked or lined up in with the electrical charge in one direction, and this is one of the effects that creates the surface tension in a fluid.

When applying an electrical field, E, to a charged particle, this particle will experience a force F given by $$F=qE \tag{1}$$

If the particle has mass m, it will experience an acceleration, which, according to Newton's second law is $$a=F/m=qE/m \tag{2}$$

Let us look at a charged particle in a region of uniform electric field with the magnitude and direction of E the same everywhere. This region of electric field may be approximated in practice by maintaining equal but opposite charges on two conducting plates.

Equation (1) asserts that a charged particle in a uniform field experiences a constant acceleration. Then all the kinetics, dynamics and energy relationships associated with particles undergoing constant acceleration apply to a charged particle in a uniform field. For example, if we assume a constant electric field of magnitude E in the y direction, a particle of mass m bearing a charge q in that field has a constant acceleration $a_y$=qE/m. The kinetics equations for constant acceleration apply:

$$y=y_o+y_{oy}t+qEt^2/2m \tag{3}$$

$$v_y=v_{oy}+qEt/m \tag{4}$$

$$v_o^2=v_{oy}^2+2qE/[m(y-y^o)] \tag{5}$$

Let us choose the x direction as horizontal and the y direction as vertical, and let the initial position of the charged particle be at the coordinate origin.

The initial velocity $v_o$ of the charged particles has components $v^o_x=v^{oy}=v^o/2^{0.5}$. Because E is in the positive y direction, the constant acceleration of a negative charged particle is in the negative y direction. Because the charged particles experiences no acceleration in the x direction, we may adapt Equation (3) for both the x and the y direction of the charged particle at any time t::

$$x=v_{ox}t \tag{6}$$

$$y=v_{oy}t-qEt^2/2m \tag{7}$$

When the charged particle has returned to its original height, y=0, Equations (6) and (7) may be written:

$$d=v_{ox}t \quad (8)$$

$$v_{oy}=qEt/2m \quad (9)$$

Eliminating t from Equation (8) and using $v_x=v_{oy}=v_o/2^{0.5}$ gives $$E=2mv_{ox}v_{oy}/qd=mv^2/qd \quad (10)$$

The kinetic energy of a charged particle after it has been released from rest in a uniform field that is in the positive y direction is E=Ej. Suppose the particle has a mass m and charge q. When the particle has moved from the origin to a position y, the particle will have acquired kinetic energy $K=mv^2/2$. Equation (5) provides that $vy^2=2qEy/m$, so that the particle has a kinetic energy of $$K=m/[2(2qEy/m)]=qEy \quad (11)$$

at position y.

The kinetic energy of the particle may also be calculated using the work-energy principle, and will be the same. The work done by the resultant force on a particle is equal to the change in the kinetic energy of particle. When a particle with charge q moves from the origin to a position y, the work on that particle by a constant force qEj is qEy. Thus the change in the kinetic energy of the particle, and therefore its kinetic energy at the position y, is K=qEy, a value identical to that of Equation (11).

Now this is a charged particle in a uniform field. Using the EEOR principle, we have an oscillating electrical field and thereby we will achieve an oscillating motion of the particles (ions) in accordance to Equation (2). If we look at a round drop with ions (FIG. 4-3), the ions at the surface will encounter the electric field at a different time and be accelerated in a different direction because of the curvature on the drop. Because of the opposite charges of the anions and the cations, the ions will also be accelerated in opposite directions. These opposite accelerations of the particles are probably what gives rise to the capillary waves on the interfaces mentioned earlier.

The total energy delivered to the ion concentration at the surface creating the capillary waves has to be able to actually break the free surface energy of the liquid, i.e., it has to exceed the free surface energy.

We believe that breaking the surface tension creates an effect similar to that of a chemical surfactant reducing the same tensions and reducing the "clogging effect" of water droplets in the pore necks.

The electrical stimulation of the well can be arranged in different ways depending on the actual well configuration. The energy is delivered from a step-wise regulated transformer with a complete set of instrumentation to monitor the current, voltage and energy delivered over each phase. The power to the wellheads is delivered by cables normally buried 30 cm under the ground. The cables at the wellhead are connected to the power-carrying cable down the well, which can be:

1. By insulated casings stripped at the "pay" zone—the cables are directly connected to the casing at the wellhead.
2. By under-reaming of the existing casing above the "pay" zone—the current is delivered either by a downhole cable to the casing at the pay zone or via the tubing when using insulated centralisers.
3. By "antenna wells" directly on the casing at the wellhead.

In any of these arrangements, electrical safety is maintained by normal protection of any current-carrying parts. The wellhead itself is protected by a fence.

Each site is designed individually and an installation can consist of new drilled wells, under-reamed wells and existing wells used as "antennas."

Figure 2:
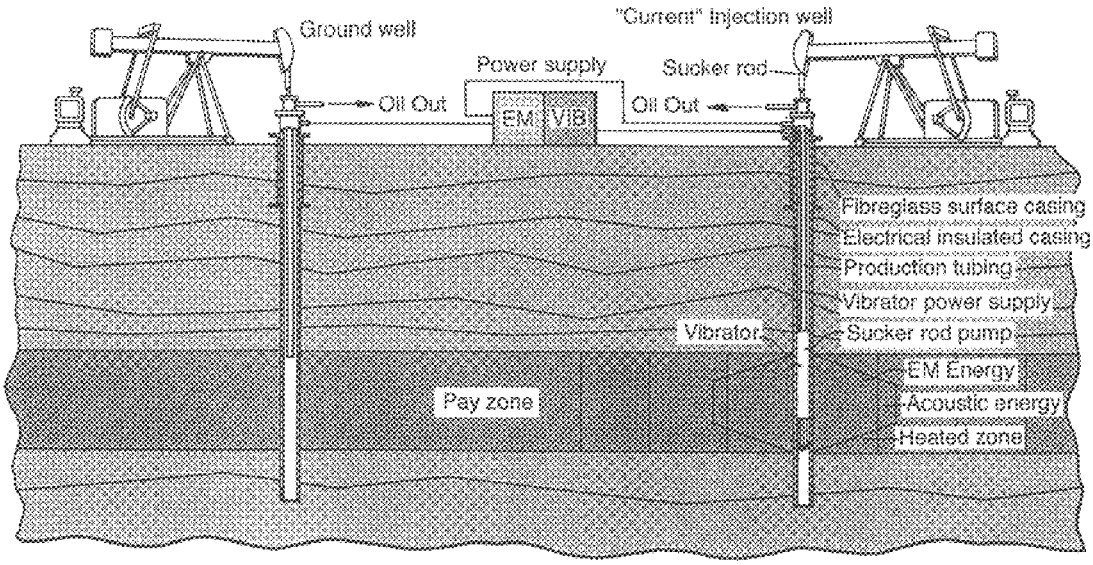
FIG. 2 (PRIOR ART)
FIG. 2 is a schematic drawing representing physical components of the Eureka oil recovery principle as known in the art.
Figure 3:
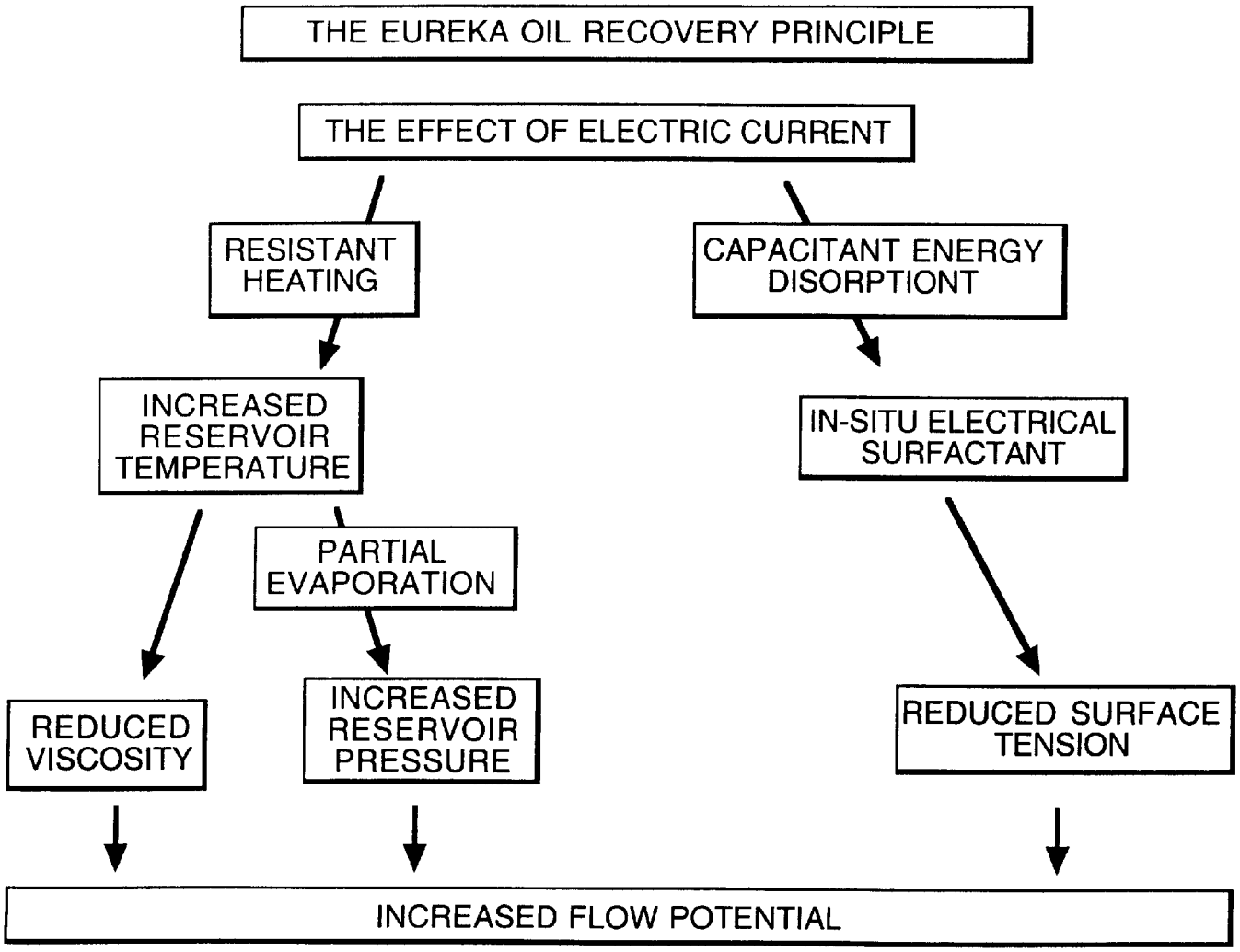
FIG. 3 (PRIOR ART)
FIG. 3 is a flow chart diagram of the Eureka oil recovery principle as known in the art.

A typical arrangement is shown in FIG. 2. The total effect of the electrical stimulation is illustrated in FIG. 3.

The challenges or possibilities related to relatively weak elastic wave stimulations of a reservoir were first addressed by researchers in the United States and the Soviet Union in the late 1950s. The activity peaked in the early 1970s in the United States and continued in the 1970s and 1980s in the Soviet Union. Most of the work in this area has been conducted by Soviet research and industrial institutions, primarily the Institute of Physics of the Earth of the U.S.S.R. Academy of Sciences, the Krylov Institute of Oil and Gas (VNNII), and the Institute of Nuclear Geophysics and Geochemistry (VNNIIYaGG) (currently VNNIIGeosystem), all in Moscow, as well as the Special Design Bureau of Applied Geophysics of the Siberian Branch of the U.S.S.R. Academy of Sciences in Novosibirsk. In addition, this review includes an outline of the results published in the Russian literature not readily accessible to western researches.

Interest in the effect of elastic waves on oil and water, oil, and gas production dates back to observations made to find the correlation between water-well levels and seismic excitation from cultural noise and earthquakes. A sharp change in water level in a 52-m-deep well in Florida caused by nearby passing trains and a remote earthquake (Parker and Stringberg, 1950) was observed. The fluctuations caused by trains were approximately 1–2 cm and were comparable with the fluctuation caused by the earthquake. Unfortunately, the distance from the source is not reported in this paper. The low-frequency fluctuations were caused by changes in atmospheric pressure and earth tides. The same work reported a 1.4-m fluctuation in the water level at a different well in Florida attributed to an earthquake originating 1200 km away.

Barbarov et al. (1987) studied the influence of seismic waves produced by a vibroseis-type source at excitation frequencies of 18–35 Hz on water levels in wells 100–300 m deep. Kissim (1991) summarised the results of these experiments. The seismic waves produced water-level fluctuations of 1–20 cm. In addition to these short-term fluctuations, longer term changes in water level induced by a seismic source were observed for periods up to five days. The presence of resonance frequencies to which aquifer responded sharply is noted. Barbanov et al. (1987) observed that the effects of vibroseis-type sources of aquifers were comparable to those of teleseismic earthquakes. A sharp fluid pressure response in California aquifers associated with the Landers earthquake was reported recently (Galloway, 1993). Observations from this earthquake show a 4.3-fold increase in the fluid pressure that decayed exponentially for several days to weeks. It is worth noting that the decay rate is consistent with the one observed by Barbanov et al (1987) after vibratory action.

The extensive study of hydrogeological effects produced throughout the world by the Alaska earthquake of 1994 revealed a significant influence on fluid level in wells (Vohris, 1968). The earthquake was purported to have produced observed changes in well levels in Canada, England, Denmark, Belgium, Egypt, Israel, Libya the Philippines, Iceland, South Africa and northern Australia immediately following the passage of seismic waves. An astonishing 7-m fluctuation in a well in South Dakota was reported (Vohris, 1968). A change about 1 m was reported in a well in Puerto Rico (Vohris, 1968).

Numerous investigations also show the effect of earthquakes on oil production. Steinbrugge and Moram (1954) described variations in oil production in Kern county during the Southern California earthquake of Jul. 21, 1952. Several of the wells showed increased casing pressure many times above normal in the first few days following the earthquake. However, several wells in the same field did not show changes, indicating a complex nature to the effect. One example is cited where two neighbouring wells behaved very differently. One well showed an increased production from 20 bbl/day to 34 bbl/day immediately after the earthquake, whereas another dropped in production from 54 bbl/day to less than 6 bbl/day.

Simkin and Lopukhv (1989, 14) cite an example from the Starogroznenskoye oil field in the Northern Caucasus, where production increased by 45% following the earthquake of Jan. 7, 1938.

Summary of Case Studies of Earthquake Influence on Oil Production

| Case No | Reference | Field location | Earthquake magnitude | Seismic intensity in oil field (12-pt. scale) | Epicentral distance (km) | Observed effect | Duration of effect |
|---|---|---|---|---|---|---|---|
| 1 | Steinbrugge and Moran (1954) | Kern Country California | 7.6 | 8–11 | 80 | Mixed effects of increased and decreased oil production, increased casing pressure | |
| 2 | Smirnova (1968) | Cudermes field, Caucasus | 3.5 and 4.5<br>4.5 and 4.2 | 5–7<br>4–7 | 10–15<br>10–15 | Increased oil production, largest effect near faults | Less than a month |
| 3 | Voytov et al. (1972) | Different fields in Daghestan and Caucasus | 6.5 | 4–7 | 50–300 | Large change in oil production, renewed production in abandoned wells, changes in production associated with passive faults | several months to three years |
| 4 | Osika (1981) | Anapa, Northern Caucasus | 4.8 | 6 | 30 | Increased oil production from some wells, pronounced near anticlines, increased oil pressure | |

A number of publications consider the proposed mechanisms of the effects of weak elastic waves on saturated media in detail (Bodine, 1954a, 1954b, 1955; Duhon, 1964; Surguchev et. al., 1975; Gadiev, 1977; Wallace, 1977; Kuzenetsov and Efimova, 1983; Kissim and Staklianin, 1984; Vakhitov and Simkin, 1985; Sadovskiy et. al., 1986; Simkin and Lopukhov, 1989; Kuzenetsov and Simkin, 1990; Kissin, 1991; Simkin and Surguchev, 1991).

Figure 4:
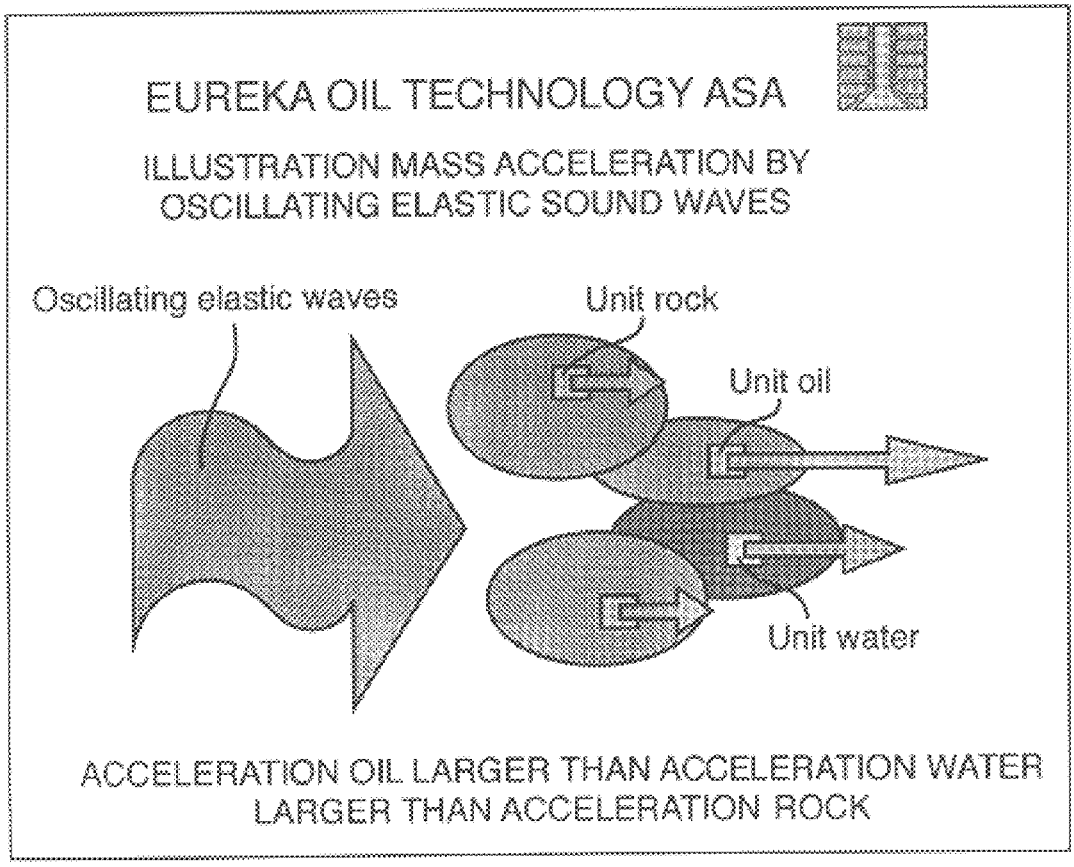
FIG. 4 (PRIOR ART)
FIG. 4 is a schematic illustration reflecting mass acceleration due to oscillating elastic sound waves according to the Eureka oil recovery principle, as known in the art.

Fundamentally, gravitational and capillary forces are principally responsible for the movement of fluids in a reservoir (Simkin, 1985; Odeh, 1987). Gravitational forces act on the difference in density between the phases saturating the medium, as illustrated in FIG. 4.

The residual oil in a typical depleted reservoir is generally contained in the form of droplets dispersed in water. Density differences induce the separation of oil from the water, which is a well-known effect in gravitational coalescence. Capillary forces play an important role in liquid percolation through fine pore channels. Liquid films are adsorbed onto pore walls during the percolation process. These films reduce the normal percolation by reducing the effective diameter of the pore troughs. If the pore is small, the boundary film may block percolation altogether. Percolation may resume only when some critical pressure gradient is applied. Furthermore, the presence of mineralization in the percolation fluid changes the thickness of the fluid film. Calculations show that the average thickness of the surface film of water in a porous channel is inversely proportional to the salt concentration, and ranges from 5 $\mu$m (NaCl solution with a concentration of 100 g/L) to 50 $\mu$m (concentration of 1 g/L) (Kuznetsov and Simkin, 1990, p. 123; Fairbanks and Chen, 1971: Dawe et. al., 1987).

In saturated reservoirs, the water and oil phases are intermixed and dispersed within each other. The important attribute of the relative permeabilities between the phases, which governs the oil yield factor, is the existence of a threshold oil saturation level, So, below which the oil is immobile (Odeh, 1987; Nikolaevskiy, 1989). At lower oil saturation, oil breaks into isolated droplets. As a result, the oil yield of a water-bearing stratum exhibits a physical limit of So=1. For example, if So=0.3, then only 70% of the oil can be extracted using its natural mobility.

Nikolaevski (1989) speculates that the excitation of elastic waves can change the phase permeability, thereby increasing the mobility of the oil below So. Elastic wave fields may reduce the influence of capillary forces on oil percolation considerably, resulting in an increased rate of migration through the porous medium. This appears to explain why vibration of the surface reduces the adherence of fluid to it. Mechanical vibrations destroy the surface films adsorbed on the pore boundaries, thereby increasing the effective cross-section of the pores. The destruction of films occurs from both weak and intensive wave fields. In the latter case, a number of different non-linear effects produced by intense ultrasound such as in-pore turbulence, acoustic streaming and cavitation (Kuznetsov and Simkin, 1990, 126–127) may also contribute to this effect. Another effect increasing percolation is the reduction of the surface tension and viscosity of liquids in the ultrasonic field, which apparently is caused by heating of the medium as a result of ultrasound absorption (Johnson, 1971).

Low-frequency waves are less likely to produce non-linear elastic effects because the wave intensity (density of energy flux) is proportional to frequency squared (Nosov, 1965, 5). However, in the presence of an alternating pressure field whose wavelength exceeds the diameter of oil droplets and gas bubbles in the water, droplets are induced to move because of their different densities (Kuznetsov et al., 1986; Sadovskiy et al., 1986). A theory describing this effect was developed by Vakhitov and Simkin (1985, 189–191), and Kuznetsov and Simkin (1990, 220–222). Because gas bubbles usually adhere to the surface of the oil droplets, they carry oil droplets in response to the oscillatory field (Simkin, 1985).

Figure 5:
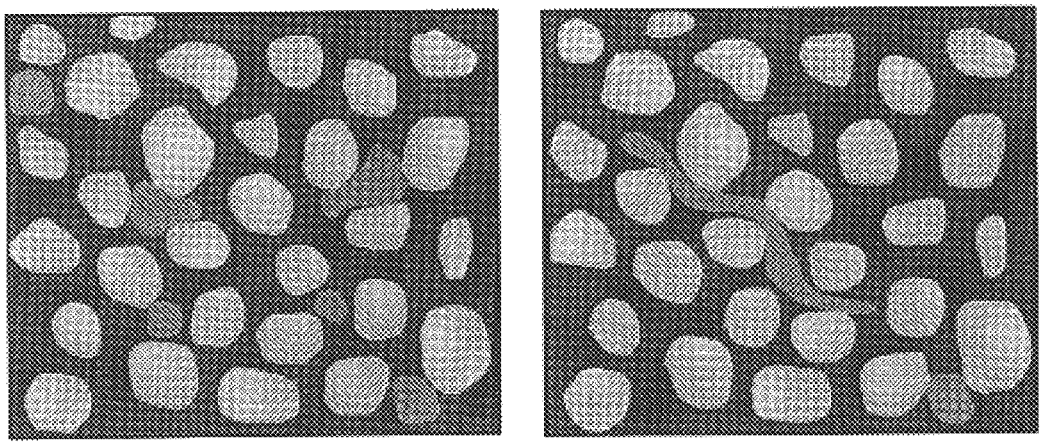
FIG. 5 is a schematic illustration of continuous streams of oil capable of flow that are formed out of oil droplets when the droplets are exposed to vibrations.

Bjerknes forces, which are attractive forces acting between the oscillating droplets of one liquid in another, induce the coalescence of oil droplets (Nosov, 1965, 13; Kuznetsov and Simkin, 1990, 129). Thus, as shown schematically in FIG. 5, continuous streams of oil capable of flow may be formed out of oil droplets dispersed with wave excitation.

Most of the mechanisms involving fluid percolation described above apply to the effects of relatively weak elastic waves. Major mechanisms involved in cases of weak and strong excitation seem to be essentially different. For example, high-density ultrasound is proposed for the procedures to remove wellbore damage caused by scales and precipitants. The effect produced in this case is purely mechanical destruction of local deposits, and has nothing to do with enhanced oil mobility. What is missing in the present investigation of the effect of weak elastic waves on saturated media is a quantitative description of the major mechanisms and the numerical model theory that could predict the results.

The amount of oil recovered increases with decreasing oil viscosity, and explains some of the synergy effect with electrical and sound stimulation of the reservoir.

Cherskiy et al. (1997) measured the permeability of core samples saturated with fresh water in the presence of an acoustic field. According to their description, the permeability of the samples increased sharply (by a factor of 82) within a few seconds of the beginning of the pulse-mode treatment; however, the permeability decreased to the value before the stimulation a few minutes after the acoustic field was turned off.

Figure 6:
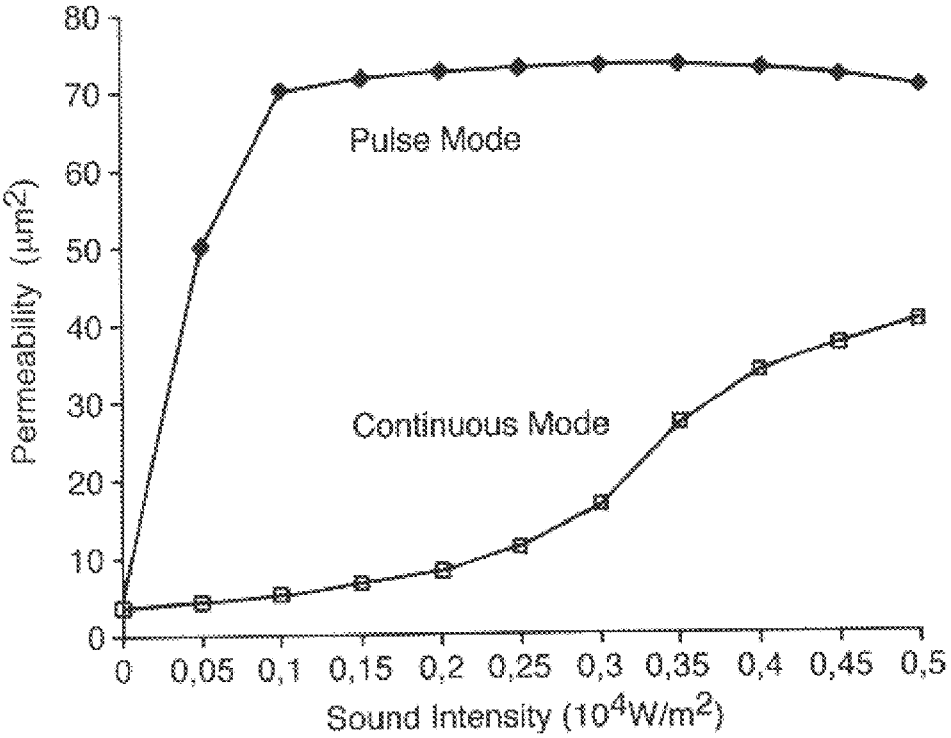
FIG. 6 shows the results in graph format for both pulse and continuous wave mode excitation as a function of the sound intensity.

FIG. 6 shows the results for both pulse- and continuos-wave (cw) mode excitation as a function of the sound intensity.

The same permeability values were obtained in the pulse mode as in the continuous mode, with intensities 10 to 15 times lower. This may be explained by the continuos mode causing the fluid droplets to oscillate, whereas the pulse mode propagates directed pressure pulses. This effect can be illustrated by gently knocking on a paper plate with small water droplets. The pulses will make the water slide in a direction opposite to the direction of the pulses.

All mechanical oscillations in a medium will eventually be converted into heat by the damping effect. The heat thus released from the vibrations will raise the temperature with a corresponding reduction in the viscosity and possibly also a partial phase transition (evaporation) of the fluids.

The mechanical force carried by the vibrations may also result in "frictional heat" due to different accelerations of the matrix and the fluids because of their differing densities.

Reduced hydraulic friction near the oil well was reported in work performed with ultrasonic treatment of an oil well in the Soviet Union. The same effect may also be achieved with low-frequency vibrations by generating pink noise where the low-frequency waves are modulating higher frequencies oscillations. This results in an absorption of the higher frequency mode in the well area, giving rise to reduced hydraulic friction, while the low-frequency mode may continue deeper into the formation and contribute to the effects described above.

C: C. Holloway present the following approach to the effect of sonic stimulation of an oil reservoir:

The minimum pressure gradient required for "snap-off" is calculated as follows. Darcy's law for the fluid flow rate is:

$$q/Ar=(k/\mu)(dp/dx)$$

where:

q=flow rate ($cm^3$/sec),

Ar=cross section area (both rock and pores) ($cm^2$), k=permeability (Darcy), $\mu$=viscosity (cp), and dp/dx=pressure gradient (atm/cm).

The flow rate through the cross-sectional area of pores only is:

$$q/Ap=(k/e\mu)(dp/dx)$$

$$q=(k/e\mu)(dp/dx)*Ap$$

where:

Ap=cross-sectional area of pores only ($cm^2$) and e=porosity

The rate of flow through a pore of radius r is:

$$q=(3.14r^2k/e\mu)(dp/dx).$$

At a frequency of N cycles per second, the time in which the flow can occur is 1/2N seconds, so the volumetric flow is:

$$Q=(3.14r^2k/2Ne\mu)(dp/dx)\ (cm^3).$$

Imposing the condition for snap-off, $$(3.14r^2k/2Ne\mu)(dp/dx)^3\ (p/6)(7r)^3.$$

Solving for the required pressure gradient, $$dp/dx^3(Re\mu N/k)[(7)313](atm/cm).$$

For a grain size of 10 $\mu$m, the pressure gradient required for snap-off is $$dp/dx=18.9\ N\ (psi/ft).$$

The minimum pressure gradient were calculated for different frequencies at 50 m from the stimulated well:

| | | Frequency (Hz) | | | | | |
|---|---|---|---|---|---|---|---|
| Radius | Static | 0,0016 | 0,016 | 0,16 | 1,6 | 16 | 160 |
| 50 m | 0,088 | 0,129 | 0,51 | 3,1 | 26 | 257 | 2.567 |

Yenturin A. Sh., Rakhimkulov R. Sh., Kharmanov N. F. (Bash NIPIneft) has presented the following approach as regard choice of frequencies to work in the formation in the zone adjacent to the well using vibratory processes:

Over the last few years there has been a growing interest for the use of acoustic fields and wave phenomena to intensify the various processes to extract petroleum and also to increase the extraction index of oil from the formations. The reason is the rational use of energy, the considerable acceleration and the better performance of some technological processes in a wave field. The best prospects are in working on the formation in the zone adjacent to the well using vibratory and wave processes, to intensify the oil extraction. In this way a deeper cleaning of the reservoir rocks and also the most efficient water injection and other displacing agents of the petroleum are obtained.

The oil extraction index can be increased using a better percolation of the water in consequence of the cleaning in the zone adjacent to the well, with low permeability formations coming into production and with a greater degree of displacement of the petroleum by the water or by other agents.

One of the fundamental questions for developing techniques that involve wave processes is to determine penetration depths of the acoustic energy in the formation, sufficient to move the fluids in the rock pores. To generate wave fields in the zone adjacent to the well hydrodynamic irradiation devices are used that are based on the energy of the flow of a liquid pumped through them, and also high frequency sonic and ultrasonic generators with electrical input (1). Therefore, as the production practice shows, the hydrodynamic devices and sonic generators do not always obtain a positive effect, specially in injection wells. This is explained, firstly, by the fact that when establishing the basic parameters of the generators, the frequency and intensity of the acoustic field that must be determined in the concrete conditions of the deposit are not always taken into consideration. For this reason it is of practical interest to study the effective penetration depth of the acoustic waves in the formation.

There, basically, two methods to increase the oil extraction index using acoustic fields. The first is summarized in provoking vibrations in the formation itself, for example using seismic acoustic waves. In this case the oscillation energy in the elementary mass dM is determined by the equation:

$$dE=0,5*\overline{\omega}^2A^2\Delta M$$

where $\overline{\omega}$—frequency of the vibrations; A—range of the displacements.

Consequently to generate vibrations in the rock, a very strong energy is needed which makes this method difficult to do.

It is the second method that has better prospects, which is based on the generation of hydrodynamic pressure waves in a fluid and their spread through the formation pores. We shall examine this method in more detail. The most common productive formations have pores with diameter r that varies, predominantly, between 1 and 10 micra (1/1000 mm). Due to the existence of friction forces between the liquid and the walls of the pores, the formation presents attenuating properties in relation to the hydrodynamic waves, and when choosing the acoustic field, one of the determining factors can be the effective penetration depth of these waves in the rock.

The spread of the energy from the vibrations through the internal friction of the liquid and its thermal conductivity is relatively small if compared to the dispersjon caused by the friction next to the wall of the pore channels (2). For example, the range of the plane wave in water at frequency 3 MHz becomes only 10 times less at a distance of 10 meters. For this reason, the known equations of the acoustic (movement, continuity and state) can be presented in the following manner (2):

$$-\delta p/\delta x=\rho\delta u/\delta t+\rho\alpha u^2,-\rho p/\delta t=pc\delta u/\delta x \qquad 1$$

where p, u—hydrostatic pressure and displacement speed; x—distance; t—time; ρ-density of the liquid; $\alpha=\lambda/8\delta$; c—speed of the sound in the liquid; λ—coefficient of hydraulic resistance; $\delta=F/\kappa$—hydraulic radius of the flow section (for round channels 5=0.5 r); F—flow area; κ—soakable perimeter.

For a porous medium $$\lambda=2\nu/v_\phi(m/k)^{0,5} \qquad 2$$

where ν—kinematic viscosity of the liquid; m—coefficient of the rock porosity; $v_\phi$—filtration speed; k-roch permeability.

The filtration speed has the components static (in the calculations, to make it simpler, we assume that it is constant in the x length) and $\mu$ variable. If there is a need to take into consideration the internal losses in the liquid in the system 1 in a linear form c is substituted by the complex speed of the sound.

For the harmonic zones the Fourier transformation can be used in the form $u=Ue^{j\overline{\omega}t}$. Then, reducing system 1 and a wave equation, we will have, after the elementary transformations:

$$-\overline{\omega}^2U+jn\overline{\omega}U=c^2d^2U/dx^2,\ n=\nu m/2r(m/k)^{0,5} \qquad 3$$

The limitrophe equations for the equation 3 has the form u=0 being $U=U_o$($U_o$—range of the alternate displacement at the opening of the well, caused by the hydrodynamic generator) dU/dx=0.

Equation 3 is a linear differential equation of a well-known kind. Using the Laplace transformations in sequence and the algebraic transformations, we shall have the final result of the equation 3 in the form:

$$U(x)=U_o(sh^2\alpha\beta x+\cos 2\beta x)^{0,5}\ \exp(-tg\alpha x tg\beta x) \qquad 5$$

Where:

$$\alpha=\alpha_1;\ \beta=\alpha_2;\ \alpha_1=\omega/c2^{0,5}[(1+n2/\omega2)^{0,5}+(-1)^i)]^{0,5}$$

(i=1, 2)

Passing from U to the hydrodynamic pressure p, U=p/ρc substitution is used.

Figure 7:
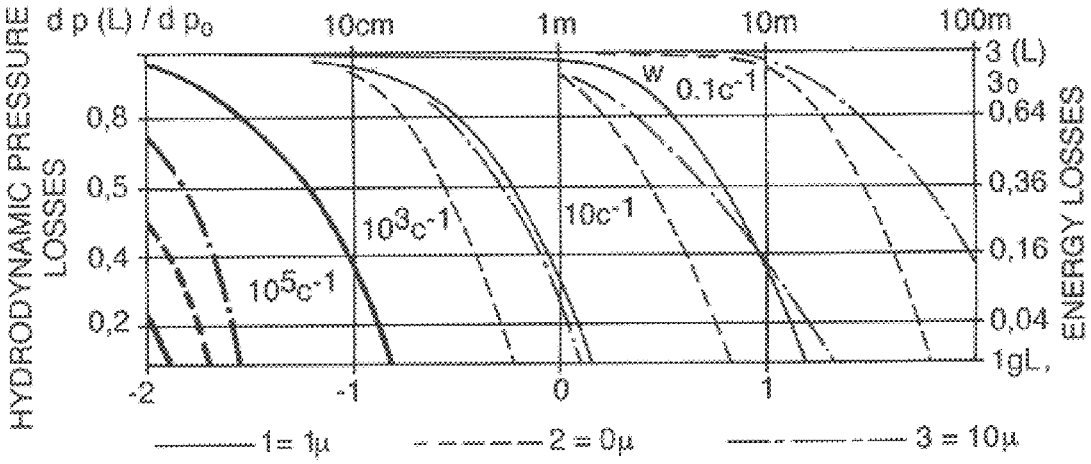
FIG. 7 is a graphical representation of hydrodynamic pressure and energy losses as a function of distance and viscosity of a fluid.

In FIG. 7, the results of the calculations appear (using the equation 5) for the hydrodynamic pressure losses, . . . $\Delta p_{(L)}/\Delta p_o\cong U_{(L)}U_o$ in relation to the length of the pore channel L, as well as to loses relating to energy $\in_{(L)}/\in_o\cong U^2_{(L)}/U_o^2$.

As shown in the figure, the effective penetration depth of the ultrasonic waves with a frequency of $2.10^4$–$10^{10}$ Hz is no greater than 1–2 cm. Consequently, the ultrasonic waves are only usable for a not so deep acoustic treatment in the formation in the zone adjacent to the well.

The low frequency waves (20–40 Hz) can be used for the treatment down to a 1–2.5 m penetration depth. For a deeper hydrodynamic treatment it is recommend to use a generator with infrasonic frequencies (0.5–5 Hz). So tests carried out at the UNI on sandstone samples with permeabilities of 0.115–0.16 $\mu^2$ made it possible to obtain a reduction in the residual petroleum of 11.6–32.3% with vibrations at the frequency of 2–4 Hz and pressure range of 2–20 MPa (smaller residual petroleum indices were seen in rocks with less permeability).

For a greater increase in the petroleum extraction index we can consider that the most efficient waves are the sub-infrasonic hydrodynamic ones (frequency less than 0.5 Hz). Among the latter the cyclicle pumpings can be considered, that produce an increase in the petroleum extraction index (the frequency of the cycles is less than $2.10^{-6}$ Hz).

When the wave processes are applied to heterogenous concrete layers, the hydrodynamic effect can be intensified diverting the waves to the side of the low permeability layers, which is managed through the prior plugging of the more permeable rocks. It is expected that this combined effect must be more effective with lower frequency waves.

When choosing the acoustic fields, we must take into consideration that the subinfrasonic waves differ to only a slight degree of attenuation and dispersjon when passing through the pipe. Thus for their generation, automatic hydrodynamic generators can be used on the surface, which together with the rational control of the pumping system in groups of wells and by using computers, may increase the petroleum extraction index of the fields.

Based on what we have already presented about electrical and sonic stimulation of an oil reservoir, we have found that the EEOR electric and sonic methods give a positive synergy effect when applied together. The main reason is believed to be that as the electrical stimulation breaks the surface tension and reduces the thermal viscosity, it favours the effect of the acoustic stimulation to a much larger extent than when the vibrations are applied alone.

This synergy effect not only increases the yield of the oil but also gives a greater production flow, and thus reduces the energy costs per unit of oil produced.

To verify this idea, two identical artificial oil reservoirs were constructed of a sandstone from an outcrop in Bahia, Brazil, with a permeability of 500 mD. The sandstone was coated in reinforced epoxy and was equipped with three production wells and injection wells for the water drive. The reservoirs were filled with water and crude oil. These were the ninth and tenth tests performed in Brazil.

In the first test, the reservoir was depleted using the water drive without any stimulation until we reached a water breakthrough in the producing wells. The reservoir was then stimulated with electricity and vibration simultaneously.

Figure 8:
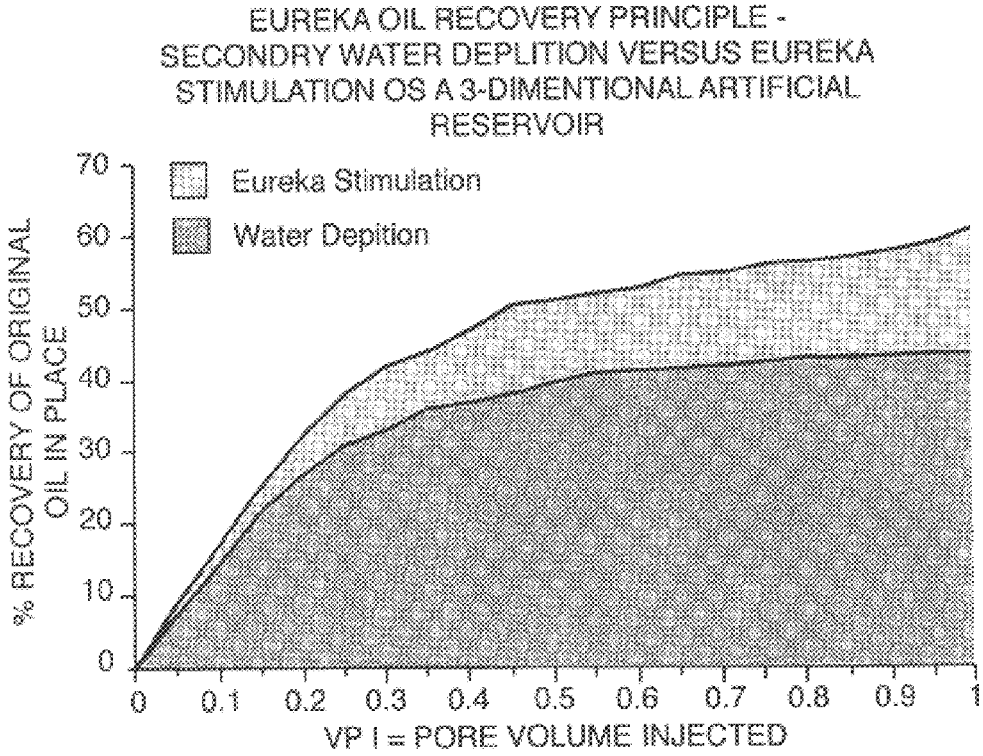
FIG. 8 is a graphical comparison of secondary water depletion versus the Eureka stimulation of a three-dimensional artificial reservoir as a function of pore volume injection.

In the second test, the reservoir was stimulated from the start using the complete EEOR process. The results are presented in the graph of FIG. 8, and show clearly the increased production flow in the second test, which clearly shows the synergy effect of the process.

As have now been explained above regarding electric and acoustic stimulation by known methods, one can observe that the energy from the different stimuli is dissipated from the well in accordance to a logarithmic scale.

To improved the oil recovery in addition to the above mentioned methods, it would be advantageous to make it possible to have the energy dissipated at a wider area from the well, but also the gain an in-situ vibration effect different from the one described above.

One way to obtain this would be to have several vibrators extending radically out from the well bore. But, this is an impossible task.

We have thus looked at other possibility to create a vibration medium from the well bore and which will be described as follows:

One standard operation in well completion and after the well has been completed, is to perform so-called fracturing of the reservoir by sand mixed in water and certain chemicals to aid the penetration of the sand into the reservoir.

The fracturing job is done by that the mixture of sand, water and chemicals are injected into the well and by a certain pressure, the mixture is pressed into the formation. This can be observed as a sudden drop in the pumping pressure at the surface. Normal facturing jobs can fracture up to 400 feet into the formation.

Now, as we know that an alternating electric field is to be passed from the wells and into the formation, it is thus possible to have the electrical current affecting a substance which will respond mechanically to the alternating current. Such a substance would be any magnetic material such as magnetite, small ceramic and metallic magnets etc. But in addition to such materials, other electrostrictive materials can be applied such as "Terfenol" which is an alloy of Ferrum, Terbium and Dysprosium. Other such materials can be piezoelectric minerals, alloys of rare earth metals or other similar organic or inorganic materials. Further more, the textbook <<The Application of Ferroelectric Polymers>> by T. T. Wang, J. M. Herbert and A. M. Glass describes a number of such materials which can be used in combination with a fracturing operation.

When applied to an alternating electric field, these substances will vibrate in-situ at the same frequency as the applied alternating current. Because of the small unit mass of the single particle, it is possible to change the frequency of the alternating current to match the best response of the vibration to the production.

Accordingly, a method of performing the invention would include performing a "fracturing" of the reservoir by injecting a substance including any magnetic or electrostrictive material into the well and into its adjacent formation, applying an alternating electric field from the well that has been used for injecting the substance into the formation, and changing the frequency of the alternating current to match the best response of the vibration to substantially reduce surface tension and assist in keeping formation pores open for fluid flow.

The invention described above is provided by way of illustration and should not be construed to limit the invention Those skilled in the art will readily recognize various modifications and changes which may be made to the present invention without strictly following the applications and methods illustrated and described herein, and without departing from the true spirit and scope of the present invention which is set forth in the following claims.

These in-situ micro-vibrations will contribute to a substantial reduction of the surface tension, but will also aid in keeping the pores open for the fluid flow.

REFERENCES

1. "Thermal Recovery Systems Uses Electricity," Pet. Eng. (July 1966)44.
2. "Enchanced Recovery Test Using Electricity Slates in Texas," Oil & Gas J. (Jun. 23, 1975) 77.
3. "AC Current Heats Heavy Oil for Extra Recovery," World Oil (May 1970) 83–86.
4. El-Feky, S. A., Theoretical and Experimental Investigation of Oil recovery by Electrothermic Technique," Ph.D. dissertation, U. of Missouri, Rolla (1977).
5. Harvey, A. H., Arnold, M. D., and El-Feky, S. A., "Selective Electric Reservoir Heating," J. Cdn. Pet. Tech. (July–September 1979)45–47.
6. Harvey, A. H., Arnold, M. D., "Estimation of Heat Distribution in Selective Electric Reservoir Heating," J. Cdn. Pet. Tech. (June 1980) 965–68.
7. Killough, J. E. and Gonzalez, J. A., "A Fully Implicit Model for Electrically Oil Recovery," paper SPE 15605 presented at the 1986 SPE Annular Technical Conference and Exhibition, New Orleans, Oct. 5–8.
8. Wattenbarger, R. A. and McDougal, F. W., "Oil Production Responses to In-situ Electrical Heating (ERH)," J. Cdn. Pet. Tech. (November–December 1988).
9. Pizarre, J. O. S., "Simulacao Numerica do Metodo de Repcuperacao de Petroleo por Aquecimento Electrico," MS thesis, U. of Campinas, Brazil (1988).
10. Prats, M., "Thermal Recovery," Monograph Series, SPE, Richardson, Tex. (1982) 7, 215–16.
11. Burger, J. et al., Thermal Methods of Oil Recovery, Edition Technip, Paris (1985).
12. Pedrosa, Q. A. Jr., "Use of Hybrid Grid in Reservoir Simulation," Ph.D. dissertation, Stanford, Calif. (1984).
13. Nghiem; L. X., "An Integrated Approach to Discretizing the Reservoir Flow Equations," CMG Technical report, Calgary (October 1983).

14. Aziz, K. and Settari, A., Petroleum Reservoir Simulation, Applied Science Publishers, London (1979) 444–46.
15. Sayakhov, F. L. Chistyakov, S. L., Bahalyan, G. A., and Fedorov, B. N., "Oil Wellbore Heating Calculating For Heating By Electromagnetic Fields (in Russian), "Neft i Gaz (February, 1972) 47–50.
16. Smyth, W. R., Static and Dynamic Electricity, 3rd Ed. (1968).
17. Craft, B. C., and Hawkins, M. F., Applied Petroleum Reservoir Engineering, p. 286 (1959).
18. Todd, J. C., and Howell, E. P., Numerical Stimulation of In Situ Electrical Heating To Increase Oil Mobility. Oil Sands of Canada-Venezuela, CIM, Special Vol. 17, 19 (1977).
19. "AC Current Heats Heavy Oil for Extra Recovery, "World Oil (May 1970).
20. White, Philip D., and Moss, Jon T., Thermal Recovery Methods, Penn Well Books.
21. Bell, C. W., and Titius, C. H., "Electro-Thermal Process for Promotinng Oil Recovery," Canada Patent 932,657 (Aug. 28, 1973).
22. Bridges, J. E., Taflone, A., and Snow, R. H., "Net Energy Recoveries for the In-situ Dielectric Heating of Oil Shale," Proc. 11th Shale Symposium, Colorado School of Mines, Golden (1978) 311–330.
23. "PETRO-CANADA Uses Electricity Before Steam, "Enchanced Recovery Week (Sep. 14, 1981)2.

Ashiepkov, J. S., Riashentsev, N. P., and Cherednikov, E. N. 1989, Controllable vibro-seismic action—A new method of the production stimulation, in Numnerical methods of percolation problem analysis. Dynamic for multiphase media (Chislenniye metody resheniya zadach filtratsii. Dinamika mnogofaznikh sred): 88–222 (in Russian).

Barbanov, V. L. Grienvskiy, A. O., Kissin, I. G., and Nikolayev, A. V., 1987, Some effects of imposed seismic vibrations on a water-saturated mediumn. Comparison with effects of distant earth-quakes: Translation (Doklady) of the USSR Academy of Science, Earth Science Section, 297, 52–56.

Bodine, A. G., Jr., Sonic Technique for Augmenting the FRow of Oil From Oil Bearing Formations, U.S. Pat. No. 3,952,800.

Bodine, A. G., Jr., Sonic Energization for Oil Field Formations, U.S. Pat. No. 3,387,075.

Bodine, A. G., Jr., Sonic Method and Apparatus for Augmenting Fluid from Fluid-Bearing Strata Employing Sonic Fracturing of Such Strata, U.S. Pat. No. 4,471,838.

Bodine, A. G., Jr. 1948, Method and apparatus for treating wells, U.S. Pat. No. 2 437 456.

Bodine, A. G., Jr. 1954, Sonic system for augmenting the extraction of oil from oil bearing strata: U.S. Pat. No. 2,667,932.

Cherskiy, N. V., Tsarev, V. P., Konovalov, V. M., and Kuznetsov, O. L., 1997, The effect of ultrasound on permeability of rocks to water, Transactions (Doklady) of the USSR Academy of Sciences, Earth Science Section, 232, 201–204.

Craford, Alan E., 1955, Ultrasonic Engineering With Particular Reference to High Power Applications, Butterford Scientific Publications.

Dawe, R. A., Mahers, E. G., and Williams J. K., 1987, Pore scale physical modelling of transport phenomena in porous media, in Bear, J. and Corapciogul, M. Y., Advances in transport phenomena in porous media; Martinus Nijhoff Publ., 48–76.

Dybinsidy, I. S., Zhuykov, J. F., Kuzenetsov, O. L., and Urazagaliev, B. U., 1978, Possibility of stimulation of oil flow under ultrasonic treatment, Express-Information, Ser. Oil Industry (Neftpromyslovoye Delo), no. 16: All-Union Res. Institute of Organisation, Management and Economics of Oil and Gas Industry (VNIOENG)(in Russian).

Dubon, R. D., 1964, An investigation of the effect of ultrasonic energy on the flow of fluids in porous media: Ph.D thesis, University of Oklahoma.

Dvali, M. F., and Sumarokov, O. M., 1968, A new method of removing paraffin from tbes and wellbores: Oil Industry (Neftianoye Khozastvo), no. 2, 45–48 (in Russian).

Dyblenko, V. P., Thfanov, L. A., Suleymanov, G. A., and Lysenkov, A. P., 1989, Percolation phenomena and processes in saturated porous media under the vibro-wave action, in Ways of intensification of oil production (Putu intensifilcatsii dobychi nefti), Proc. (trudy) Basharld Research and Design Institute of Oil (BASHNIIEFI): 45–51 (in Russian).

Erimnov, S. A., and Shilbin, A. V., 1989, Effect of acoustic field on phase permeability of rock at near-bottom well zone in oil reservoir, in Nuclear geophysics and geoacoustics methods for determining rock percolation and capacity properties in oil and gas reservoirs: All-Union Research Institute of Geo-Information Systems (VNII GeoInformSystem), 104–106 (in Russian).

Fairbanks, R. V., and Chen, W. I., 1971, Ultrasonic acceleration of liquid flow through porous media: Chem. Eng. Prog. Symp. Ser., 67, 108–116.

Fisher, S. T., and Fisher, C. B., 1997, Recovery of hydrocarbons from partially exhausted oil wells by mechanical wave heating. U.S. Pat. No. 4,049,053.

Gadiyev, S. G. and Simkin, E. M., Method of Treating the Bottom-Hole Zone of Well, USSR patent 832,072.

Gadiev, S. M., 1977, Use of vibrations in oil producing (Isopol'zovaniiye vibratsii v dobyche nefti): Nedra Press (in Russian).

Gaulitz, P. A. St. Laurent, C. M., and Radke, C. J., 1987, An Experimental Investigation of Gas-Bubble Breakup in Constricted Square Capillaries, Journal of Petroleum Technology, September 1987.

Gösele, Walter, 1986, Grenzflächenprobleme bei der Fest/Flüssig-Trennung, Chem. Ing.-Tech, 58 Nr.3, 169–175.

Holloway, Jr.; Method for Producing a Hydrocarbon-Containing Formation, U.S. Pat. No. 3,754,598.

Hueter and Bolt, 1962, Sonics, John Wiley and Sons, Inc., New York, third printing. High-intensive sonic waves harnessed for effective scale removal system, 1976, Am. Oil and Gas Reporter, 18, 58–59.

Ivchenko, Igor, Evaporation (Condensation) Theory of Spherical Particles with All Knudsen Numbers.

Kissin, I. G., 1991, Possible mechanism of vibrational effects and vibro-sensitivity of saturated media in Nokolaev, A. V., and Galkin, I. I., Eds., Physical principles of seismic method. Non-traditional geophysics, Nauka Press, 210–221 (in Russian).

Komar, C. A., 1967, Effects of ultrasonics on Appalachian paraffin. Petro. Eng., 39, 60–61.

Kuznetsov, O. L., and Efimova, S. A., 1983, Application of ultrasound in oil industry: Nedra Press (in Russian).

Kuznetsov, V. V., and Nikolaev, A. V., 1990, Elaboration of physical principles of vibro-seismic action of oil reservoir.: Institute of Physics of the Earth (in Russian).

Kuznetsov, O. L., Manwov, R. A., Malchenok, V. O., Mordukhaev, K. M., Ostrovsky, A. P., Rubtsov, A. E., Simkin, E. M., and Sokolov, A. V., Electromechanical vibrator and heater, French patent 81 22400.

Kuznetsov, O. L., Pechkov, A. A., Efimova, S. A., and others, 1987, Results of industrial investigation of the acoustics treatment of near-bottom well zone in reservoir: Oil Industry, no. 5 (in Russian).

McFall, Richard, A fluid Resonator, Canadian patent 1096298.

Medlin, W. L., and Zumwalt, G. L., 1983, Method for recovery of oil by means of gas drive combined with low amplitude seismic excitation. U.S. Pat. No. 4,417,621.

Mikhailov, V. M., Neretin, V. D., Kuznetsov, O. L. and Ertmova, S. A., 1975, Study of ultrasonic effect on percolation process in porous media, in Proc. (Trudy) All Union Research Institute of Nuclear Geophysics and Geochemistry, 24, 78–87 (in Russian).

Morris, B. P., 1974, Sonic stimulation of marginal wells: Drill. and Prod. Inst. Selec. Pap., Pap. 9.

Nikolaev, A. V., 1991, Development of non-traditional methods in geophysics of seismic method. Nauka Press. 5–17 (in Russian).

Nikolaevskiy, V. N., 1989, Mechanism and dominant frequencies of vibrational enhancement of yield of oil pools: USSR Academy of Science, Earth Science Section, 305, 570–575.

Nosov, V. A., 1965, Soviet progress in applied ultrasonic, Vol. 2: Ultrasonics in the chemical industry: Consultants Bureau, New York.

Odeh, A. S., 1987, Mathematical modelling of the behaviour of hydrocarbon reservoirs—the present and the future, in Bear, J., and Corapcioglu, M. Y., Eds. Advances in transport phenomena in porous media: Martinus Nijhoff Publ., 812–848.

Osika, D., G., 1981, Fluid regime of seismically active regions: Nauka Press (in Russian).

Peopsky, A. H., Felix, D. T., and Herbert, G. N., 1970, Sonic energy process. U.S. Pat. No. 3,497,005.

Philips, E. H., 1970, Electro-mechanical transducers for secondary oil recovery and method therefor. U.S. Pat. No. 3,527,300.

Pogosyan, A. B., Simkin, E. M., Stremovskiy, E. V., Surgachev, M. L., and Shnirel'lman, A. I., 1989, Separation of hydrocarbon fluid in water in an elastic wavefield acting on porous reservoir medium: USSR Academy of Science, Earth Science Section, 307, 575–577.

Riashentsev, N. P., 1990, Wave method of hydrocarbons production: Internat. Conference on Development of Gas Condensate Fields, reports, 292–295 (in Russian).

Sadovskiy, M. A., Absasov, M. T., and Nikolaev, A. V., 1986, Perspectives of vibrational treatment of oil reservoir for their production stimulation: Vestnik (Bulletin) of the USSR Academy of Science, no. 9, 95–99 (in Russian).

Sherbome, J. E., Recovery of Hydrocarbons, U.S. Pat. No. 2,670,801.

Simkin, E. M., 1985, Oil will return in three months: Energy no. 3, 44–47 (in Russian).

Simkin, E. M., Erimova, S. A., Kuznetsov, O. L., Pechkov, A. A., Zhuykov, J. S., Driagin, V. V., Rafikov, R. S., and Sanrkisiants, B. B., 1990, Creation and industrial realisation of technology of controllable acoustic treatment for mineral production stimulation in wells (a report): Krylov Research Institute of Oil and Gas (in Russian).

Simnk, E. M., Kuznetsov, O. L., Efimova, S. A., and others, 1975, Possibility of restoration of paraffin and clayed zones permeability in reservoirs by thermal and acoustic treatment: Oil Industry no. 10, 80–82 (in Russian).

Simkin, E. M., and Lopukhov, G. P., 1989, Vibro-wave and vibro-seismic methods of oil reservoir stimulation (a review), All-Union Research Institute of Organisation, Management and Economics of Oil and Gas Industry (in Russian).

Simkin, E. M., and Surguchev, M. L., 1991, Advanced vibroseismic techniques for water flooded reservoir stimulation. Mechanism and field results: Proc. 6th Europ. Symp. on Improved Oil Recovery (Stavanger, Norway), i, Book 1: 233–241.

Simkin, E. M., Surguchev, M. L., Akhapkin, M. J., Pohsyan, A. B., and Stupochenko, V. E., 1991, Effect of elastic oscillations on the capillary water impregnation of oil-saturated porous media: Sov. Phys. Doklady, 35, 295–296.

Snarskiy, A. N., 1982, Determination of the influence of infrasonic field oil percolation rate in elementary reservoir model: Transaction of the Higher School, Ser. Oil and Gas (Neft' i Gas), no. 1, 30–32.

Solokov, A. V., and Simkin, E. M., 1981, Study of influence of acoustic treatment on rheological properties of some oils, in Topics in non-linear geophysics, All Union Research Institute of Nuclear Geophysics and Geochemistry, 137–142 (in Russian).

Surguchev, M. L., Kuznetsov, O. L. and Simkin, E. M., 1975, Hydrodynamics, acoustic, thermal and cyclic stimulation of oil reservoirs: Nedra Press (in Russian).

Tustin, Wayne, and Mercado, Robert, 1984, Random Vibration in Perspective, Tustin Institute of Technology (1984).

Wesley, Processes and Apparatus for Electrohydraulic Recovery of Crude Oil, U.S. Pat. No. 4,345,650.

Williams, Apparatus and Method for Improving the Productivity of an Oil Well, U.S. Pat. No. 4,437,518.

Yang-Cheng and Jer Ru Maa, 1987, Microbubbles in Water and Boiling Superheat, Journal of Colloid and Interface Science, Vol. 120, No. 1, November 1987.

Kuznelsov O. L., Yefl'mova S. A.—Ultrasonic application in the petroleum industry. M., Nedra, 1983.

Khachaturyan, S. A.—Wave processes in compressors. M., Mashinostroienie, 1983.

Burdyn' T. A., Gorbunov, A. T., T'utin L. V. et al. Methods to intensify the petroleum extraction of the rocks using water flooding. M., Nedra, 1983.

Kiseliov B. L., Vashchurkin, A. I., Yevchenko, V. S. Communication about the non stationary flooding experiment in the deposits of West Siberia.—Neftyanoie khozyaistvo, 1984, no.4,pp 35–39

What is claimed is:

1. A method to increase the oil production from an oil reservoir, wherein a magnetic and/or magnetostrictive material is injected into the oil reservoir through an oil well and is put into vibration by the aid of an alternating electric field provided through the oil well, and the vibrations of the material are changeable by changing a frequency of the alternating electric field, and the vibrations disrupt the surface tension of oil and water to improve the flow of oil towards the oil well.

2. A method in accordance with claim 1, wherein the magnetic or magnetostrictive material is magnetite, hematite, steel sand or alloys of me earth metals.

3. A method for increasing oil production from an oil reservoir, the method comprising:

injecting a magnetic or magnetostrictive material into an oil reservoir through an oil well;

applying an alternating electric field to the injected material through the oil well;

vibrating the injected material with the electric field to disrupt the surface tension of oil and water to improve the flow of oil towards the oil well, the vibrations being changeable by changing a frequency of the electric field;

removing oil from the oil reservoir through the same oil well.

* * * * *